US006247247B1

(12) United States Patent
Yömaa et al.

(10) Patent No.: US 6,247,247 B1
(45) Date of Patent: Jun. 19, 2001

(54) BLOW BOX FOR THE DRYING SECTION OF A PAPERMAKING MACHINE, METHOD FOR SEALING A POCKET WITH A BLOW BOX IN THE DRYING SECTION OF A PAPERMAKING MACHINE, AND ARRANGEMENT IN A PAPERMAKING MACHINE

(75) Inventors: Seppo Yömaa, Turku; Matti Kurki, Jyskä; Raimo Virta, Turku; Reijo Jokinen, Raisio; Hannu Kokkala, Helsinki, all of (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/420,760

(22) Filed: Oct. 20, 1999

Related U.S. Application Data

(63) Continuation-in-part of application No. PCT/FI98/00360, filed on Apr. 23, 1998.

(30) Foreign Application Priority Data

Apr. 23, 1997 (FI) ..... 971729
Apr. 23, 1997 (FI) ..... 971730

(51) Int. Cl.[7] ..... F26B 7/00
(52) U.S. Cl. ..... 34/425; 34/456; 34/117; 34/120; 34/122

(58) Field of Search ..... 34/422, 425, 455, 34/456, 114, 117, 120, 122

(56) References Cited

U.S. PATENT DOCUMENTS

| | | | | |
|---|---|---|---|---|
| 4,891,891 | | 1/1990 | Wedel . | |
| 4,905,380 | * | 3/1990 | Eskelinen et al. | 34/457 |
| 4,996,782 | | 3/1991 | Eivola . | |
| 5,341,579 | | 8/1994 | Schiel et al. . | |
| 5,477,624 | | 12/1995 | Haessner et al. . | |

* cited by examiner

*Primary Examiner*—Pamela Wilson
(74) *Attorney, Agent, or Firm*—Nixon & Vanderhye P.C.

(57) ABSTRACT

A blow box used in the drying section of a papermaking machine and a method for sealing a pocket provided with a blow box, and a blow nozzle. The blow box is arranged to eject air away from the space between a wire and the blow box and/or maintain an underpressure zone in this space. In the interface between the desired underpressure zone and an outside volume, the blow box is provided with a sealing element, such as a blow nozzle, protruding towards the wire to a certain distance "d" seen from the wire, for forming a seal between the underpressure zone and the area remaining outside the underpressure zone. The sealing element is connected to the blow box so that the element may be moved away from the wire to a distance "D" by a push and/or by an actuator, the distance "D" being greater than the distance "d".

28 Claims, 13 Drawing Sheets

Fig. 17
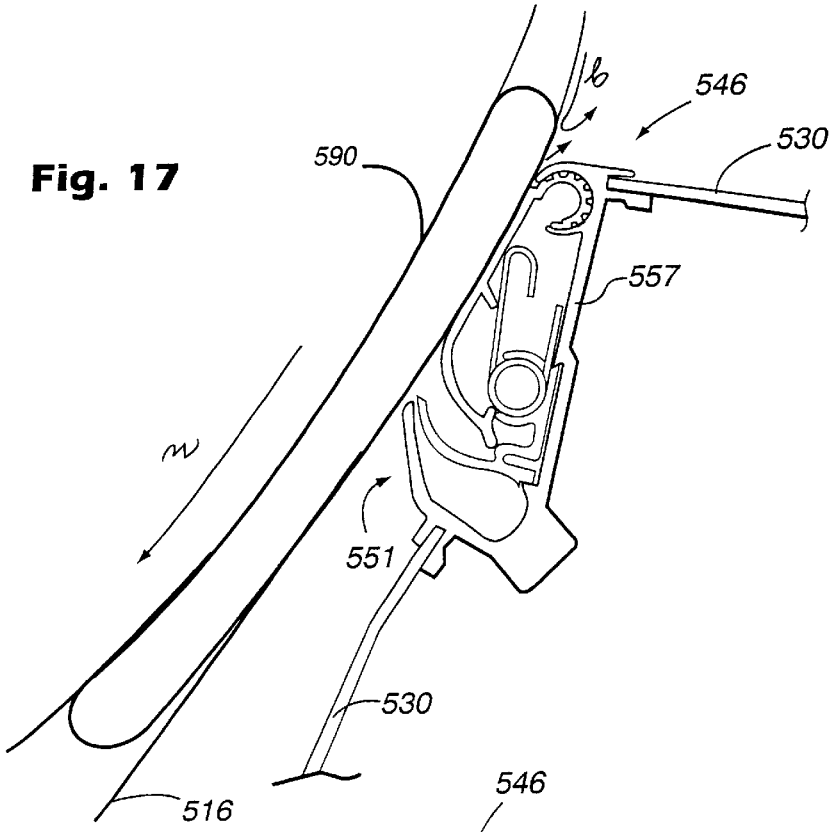
Fig. 16
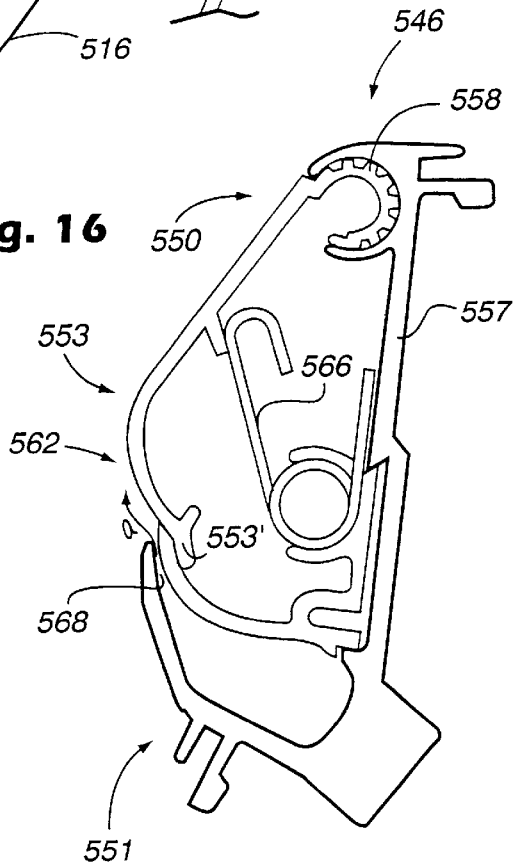
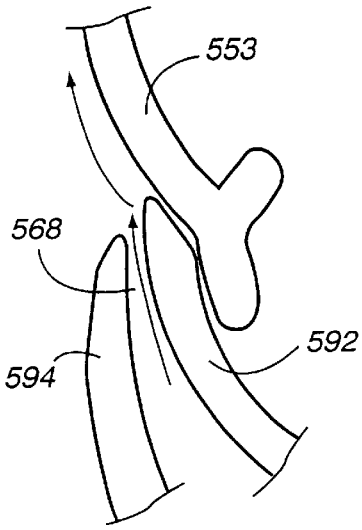
Fig. 18

BLOW BOX FOR THE DRYING SECTION OF A PAPERMAKING MACHINE, METHOD FOR SEALING A POCKET WITH A BLOW BOX IN THE DRYING SECTION OF A PAPERMAKING MACHINE, AND ARRANGEMENT IN A PAPERMAKING MACHINE

CROSS REFERENCE TO RELATED APPLICATION

This application is U.S. national phase of International Application No. PCT/FI98/00360 filed Apr. 23, 1998.

BACKGROUND AND SUMMARY OF THE INVENTION

The present invention relates to a blow box used in the drying section of a papermaking machine in accordance with the enclosed independent claims and to a method for sealing a pocket with a blow box in the drying section of a papermaking machine. The present invention also relates to an arrangement including a frame construction and a nozzle means for improving runnability in a papermaking machine.

In the drying section of a papermaking machine, the web is transported in a known way by using a single-wire or twin-wire draw. A single-wire draw refers to a draw in which the web runs from one drying cylinder to another supported by one single drying wire over the drying cylinders, the web runs between the cylinder and the drying wire.

A twin-wire draw refers to a draw in which separate upper and lower wires are used for supporting the web as it runs alternately over the upper and lower cylinders. Also in this case, the web runs over the drying cylinders between the cylinder and the drying wire. From the upper cylinder to the lower, or vice versa, the web runs partly unsupported. However, the turning rolls of the drying wires may be fitted so that the wire and the web simultaneously depart from the drying cylinder and so that the wire supports the web a short distance while it passes from one row of cylinders to another.

The drawback of previously known multicylinder single-wire dryers has been that the web is inclined to come loose from the drying wire surface as the wire and the web are transferred via a turning cylinder or roll from one drying cylinder to the next. In this connection problems particularly arise at

- the point at which the web and the wire depart from the drying cylinder, along which the web has passed between the wire and the cylinder, and at which point the web tends to depart from the wire and follow the cylinder; and
- the entry nips of the wire both on the drying cylinder and on the turning cylinders or rolls below, the web being inclined to depart from the wire at the nips, due to the overpressure induced in the nips.

The diverging of the web from the wire easily leads to the breaking of the web or at least to the web becoming baggy or formation of folds in the web. Thus, the diverging of the web from the wire leads to runnability problems which become emphasized as the speeds of the papermaking machines increase.

It has previously been known to use various blow boxes for improving the operation of papermaking machines. One such component improving the operation is disclosed in the American patent publication U.S. Pat. No. 4,905,380 relating to a blow suction box used in a multicylinder dryer of a papermaking machine. The ejection blow generated by the blow box is used for inducing an underpressure zone in a slot between the drying wire and the blow suction box wall, holding the web on the drying wire as the web passes from the drying cylinder to a turning roll underneath. An underpressure zone is generated downstream of the drying cylinder in the slot limited by the blow box wall and the wire leaving the drying cylinder, by ejecting air from the slot by air blows directed in the opposite direction to the running direction of the wire.

However, a problem with the arrangement described above is to safely seal the underpressure zone induced by blowing from the area remaining outside. In connection with malfunction, the papermaking machines create paper waste which often forms paper clods or causes the web to wrinkle, again causing problems in narrow places in the machine, for example, in the narrow spaces between the blow boxes and wires, cylinders or rolls. Due to paper clods travelling with the web, or other similar bulges in the web, it is not possible to install the blow box at a desired enough short distance from the wire run. Very long safety distances are often required between the wires and blow boxes so that the said bulges could run along with the wire past the blow box without touching it and without damaging its structures or the wire. Safety distances typically are 20 to 50 mm in single wire and 50 to 100 mm in two wire drying sections. When the blow nozzles for the blow boxes have to be placed within the said safety distance, for example, from the wire, the effects of the ejection blow often are inadequate. Neither is the underpressure zone sufficiently sealed.

It is known, for example, from the American patent publication U.S. Pat. No. 4,996,782 to use turning flaps to direct air blows to a given point from which air is to flow through the wire for ventilating the pocket formed by the wire loop. The purpose of the flap is not to seal the slot between the blow box and the wire.

The object of the present invention is to provide an improved blow box and an improved method for sealing a pocket provided with a blow box in the drying section of a papermaking machine.

The object of the invention is especially to develop further a blow box arrangement previously known so that the underpressure effect is further intensified during operation thereof.

It also is a further object of the invention to provide a blow box and method with which it is possible to control the air space between the wire and blow box also during tail threading.

An important object of the invention is further to produce a blow box with which underpressure is generated as close as possible to the element of the papermaking machine moving past the blow box, e.g. a wire, and which may be used both during normal operation and during tail threading.

It is further an object of the invention to produce such an arrangement which makes possible sufficient safety distances for a paper clod or another similar obstruction to pass the blow box along with the wire.

It also is an object of the invention to produce a nozzle for the blow box that is safe to take very close to the wire for generating ejection blowing or pocket ventilation. In this case, the object is especially to produce a nozzle the blow from which may be directed accurately and which may generate the necessary pressure differentials maintaining, however, the operational safety of the structures.

For achieving the above objects, the new blow box and method of the invention in the drying section of a papermaking machine are characterized in what is described in the characterizing part of the enclosed independent claims.

A typical blow box of the present invention used in the drying section of a papermaking machine is, in the said drying section, fitted into the pocket space limited by a wire running from the first drying cylinder to the second drying cylinder, and a turning element, such as a turning cylinder, a turning roll, a suction roll, etc. on this wire run, for ejecting air from the pocket space and for generating an underpressure zone in at least part of the pocket space. At the interface between the desired underpressure zone and the area remaining outside, the blow box is provided with one or several sealing means comprising a sealing element projecting towards the wire at a certain distance "d" from the wire, for forming a seal between the underpressure zone and the area remaining outside the underpressure zone. The said sealing element is preferably joined to the blow box so that the element may, either by pressing or by an actuator, be moved away from the wire to a distance "d'", which is larger than the distance "d".

In this specification and the enclosed claims, a blow box typically refers to box-shaped constructions extending across the web, or to other constructions extending across the web, such as beamshaped or tubular constructions, which may be used for leading ejection air to the pocket or a part of it. A blow box of the invention may also be used for sealing the slot between the end areas of the blow box and the edge areas of the wire for maintaining the underpressure zone at a desired value in the pockets also in the edge areas of the web. The arrangement of the invention may thus additionally, or solely, be used for sealing the edge zone of the pocket, and the rest of the pocket, i.e. in the transverse direction to the web, may be sealed by using some other kind of seal, e.g. a mechanical seal. The sealing arrangement of the invention may also naturally be used more generally in a papermaking machine or some other similar device at a supporting fabric or, e.g. a roll for preventing air from entering into the space between the supporting fabric, or the roll and a blow box, by ejecting air from this intermediate space.

In this specification, the wire typically refers to a dryer wire, felt or some other similar fabric by which the web is supported, for example, as it passes over the drying cylinder.

The invention may be applied to either single-wire or twin-wire drying sections of papermaking machines. In single-wire drying sections, the blow box of the invention, which is fitted into the pocket space limited by two drying cylinders, the wire runs in between, and a turning cylinder underneath, may be used for generating and sealing an underpressure zone in the running direction both in the area of the first wire run from the first drying cylinder, i.e. in the area, which in this specification is called the "entry sides", and also in the area of a wire run extending to the next drying cylinder, i.e. in the area, which in this specification is called the "exit side".

In twin-wire drying sections, the blow box of the invention, fitted into the wire pocket space limited by two drying cylinders, the wire runs in between and the turning roll of the wire, may be used for generating and sealing an underpressure zone in the wire run area extending from the first drying cylinder, i.e. on the entry side. In the area of the wire run extending to the next drying cylinder, i.e. on the exit side, blows causing pocket ventilation may be generated by the blow box.

In an advantageous embodiment of the invention, sealing is accomplished by a sealing nozzle so that air is blown from the blow box through a sealing nozzle, i.e. using a nozzle component fitted very close to the wire. On the entry side, air is blown with the sealing nozzle preferably so that air meets the wire before the wire departs from the cylinder preceding the pocket, the cylinder surface thus preventing the web from diverging from the wire due to blowing. on the exit side, air is respectively blown with the sealing blow nozzle so that air meets the wire only after the nip between the wire and the cylinder behind the pocket has closed; in this case, the blow does not diverge the web from the wire.

The blow box of the present invention is typically fitted at least at a safety distance from the wire, which distance is in single wire drying sections >20 mm typically about 50 mm and in two wire drying sections typically >50 mm up to 100 mm. The sealing component of the invention, such as a sealing nozzle, may during normal operation be brought even to a distance of less than 15 mm from the wire, typically to a distance of about 3–15 mm, preferably 5–10 mm. Thus, it is possible to intensify the underpressure effect generated by ejection between the blow box and the wire, and to seal the intermediate space between the underpressure zone thus formed and the area remaining outside the underpressure zone. The said sealing component is flexible, turnable, or it may otherwise be transferred so that, when a paper clod or some other obstruction is pushing the wire towards the blow box, it may be turned or transferred preferably to a distance "d'">"d", typically >50 mm, from the wire. A distance 50 mm may be considered sufficient, as it generally allows the paper clods in question to pass past the blow box without damaging it.

The sealing element may again be attached to an actuator which in advance transfers the element a short distance away from the wire, for example, for the duration of tail threading, when it may be expected that wrinkled paper and paper clods run along with the wire more than usual. With the actuator, the sealing element may be transferred, for example, to a distance of about 20–30 mm from the wire for the duration of tail threading.

According to an advantageous embodiment, the sealing element of the invention is formed of one or several sealing blow nozzles joined articulatedly and fitted into a stationary blow box by a link mechanism.

A sealing blow nozzle is typically formed of a slotted blow nozzle extending across the web, or of several sealing blow nozzles fitted sequentially across the web. The sealing blow nozzle is typically fitted to the blow box, in a area which is delimited by the blow box and the entry side of the wire loop, preferably to the beginning of this area as seen from the drying cylinder preceding the pocket, so that the sealing nozzle may be used for ejecting air from this zone and for thus sealing the interface extending across the web between the underpressure zone and the area outside this zone.

The blow box of the invention may principally comprise a uniform main air chamber extending across the web, provided with a sealing nozzle for blowing air and sealing the underpressure zone at least on the entry side of the wire run in a case where the entry side refers to the wire run along which the wire runs to the pocket from the preceding drying cylinder. A second sealing nozzle of the invention may, in a single-wire application, preferably be fitted onto the other side of the blow box for blowing air to the exit side of the wire run, i.e. as it runs from the pocket to the next drying cylinder, so that the entire area of the pocket limited by the blow box and cylinders, wire runs and the turning roll may be brought to an underpressurized state. In an application using a twin-wire draw, a conventional blowing nozzle may preferably be placed onto the other side, i.e. the exit side of the blow box, instead of using an ejecting nozzle, for generating a ventilating blow on this side of the blow box.

The blow box of the invention often is a whole-pocket box which, considering the safety distances, substantially fills the entire pocket space between the drying cylinders and the turning cylinder or a similar part interlaced underneath, and limited by the wire.

On the other hand, the blow box of the invention may also consist of two adjacent blow box parts extending across the wire, with a passage in between, the passage being closable with a closing element and joining the pocket space formed by the blow box and the wire loop with the space outside the wire loop. In this case, it is possible to provide the blow box with at least one blow nozzle blowing air to the passage between the blow box parts for ejecting air through the said passage from the pocket formed by the blow box and the wire loop, and for maintaining underpressure in the pocket.

The blow box parts may be formed of two, principally identically shaped air chambers, which extend across the web and which principally are mirror images of each other.

According to a further embodiment of the invention, the blow box is divided into two different parts, a main box and an auxiliary box. The main box typically is a stationary, conventional blow box extending across the web and fitted into the pocket adjacent to the closing nip of the latter drying cylinder. The auxiliary box, which is fitted adjacent to the wire run coming from the first cylinder, is movable or turnable in relation to an axis transverse to the running direction of the web so that it may be moved/turned from the normal operation position to a different position, e.g. for the duration of tail threading. In a certain position, this auxiliary box may close the passage between the blow box parts and/or form a block for the blow nozzle blowing into the passage. With this arrangement, the advantage may be gained that air outlets from different parts of the pocket may be arranged independent from each other, and thus achieve optimum air removal.

Flexible nozzles are preferably used in connection with the blow box of the invention. Upon meeting a paper clod or some other similar obstruction, they retire so that it is not possible for the paper clod, etc. travelling along with the wire to break or otherwise damage the wire, nozzle or blow box.

The sealing blow nozzle of the invention preferably comprises a stationary frame and an actual, turning nozzle element joined with it with a link. The frame part is firmly attached to the blow box extending across the web, preferably to a cavity the size of the nozzle formed in the box. The nozzle may naturally be joined to other kinds of support elements as well. The frame part of the nozzle, preferably the link in it, is provided with an air inlet joined to the air chamber in the blow box or to some other corresponding part. The actual nozzle element of the nozzle is at its first end attached to the said link of the frame part and to the air inlet in it. The other end of the actual nozzle part comprises a nozzle aperture. The nozzle aperture is connected to the air inlet connected with the first end of the nozzle through an air space inside the nozzle. In addition, the nozzle is preferably provided with a spring or some other transfer element with which the end of the actual nozzle part provided with the nozzle may flexibly be kept pushed towards the wire.

The actual nozzle part is fitted into the pocket on the entry side of the wire preferably so that, upon being pushed towards the wire e.g. by force of a spring, it turns in a sector in the running direction of the wire, as seen from the link. On the exit side of the wire, the nozzle part respectively turns in a sector in a reverse direction to the running direction of the wire, as seen from the link. The nozzle is preferably shaped so that the wall nearest the wire is convex so that, when the wire pushes against the nozzle, it easily slides past the nozzle and does not get caught in it, irrespective of the running direction of the wire. The nozzle aperture is fitted to the other, i.e. the turning end of the actual nozzle part preferably so that it directs the air flow flowing out from the aperture at least partly backwards, as seen from the nozzle part, i.e. partly along the convex outer surface of the nozzle part, outwards from the underpressure zone induced in the pocket.

A considerable improvement is achieved in the runnability of the papermaking machine in the drying section with the blow nozzle arrangement of the invention, as the apparatus of the invention is used for intensifying the underpressure effect in the wire pockets during the operation and as, again, during the tail threading, a very efficient air removal from the pockets is achieved. The underpressure effect generated by the blow box is especially well intensified as the underpressure nozzles themselves are brought as close as possible to the wire and the web running with it. It is possible to hold the paper web attached to the wire on the entry side of the pocket better than previously has been possible, as the pressure zones of the pockets may be controlled by bringing the ejection air closer to the wire and by sealing the underpressure zones from the surrounding air spaces in a better way than before. With the arrangement of the present invention, it is still possible to keep the blow box structures at a suitable safety distance from the wire and to safely move the blow nozzles to the safety distance, desired at a given time, either automatically or by using an actuator.

When the arrangement of the invention is used in a normal single-wire draw, also the amount of air of the turning suction rolls below the drying cylinders may be reduced as the blow box of the invention may be used for intensifying the underpressure effect in different parts of the pocket space.

BRIEF DESCRIPTION OF THE DRAWINGS

The invention is next described in more detail, referring to the enclosed drawings in which:

FIG. 16 is a diagrammatic vertical section of another embodiment of a sealing means of the invention in a normal operation position;

FIG. 17 shows the sealing means of FIG. 16 while being pressed away from the wire by an object passing;

FIG. 18 shows an enlargement of the nozzle lip in FIG. 16 and

DETAILED DESCRIPTION OF THE DRAWINGS

Figure 1:
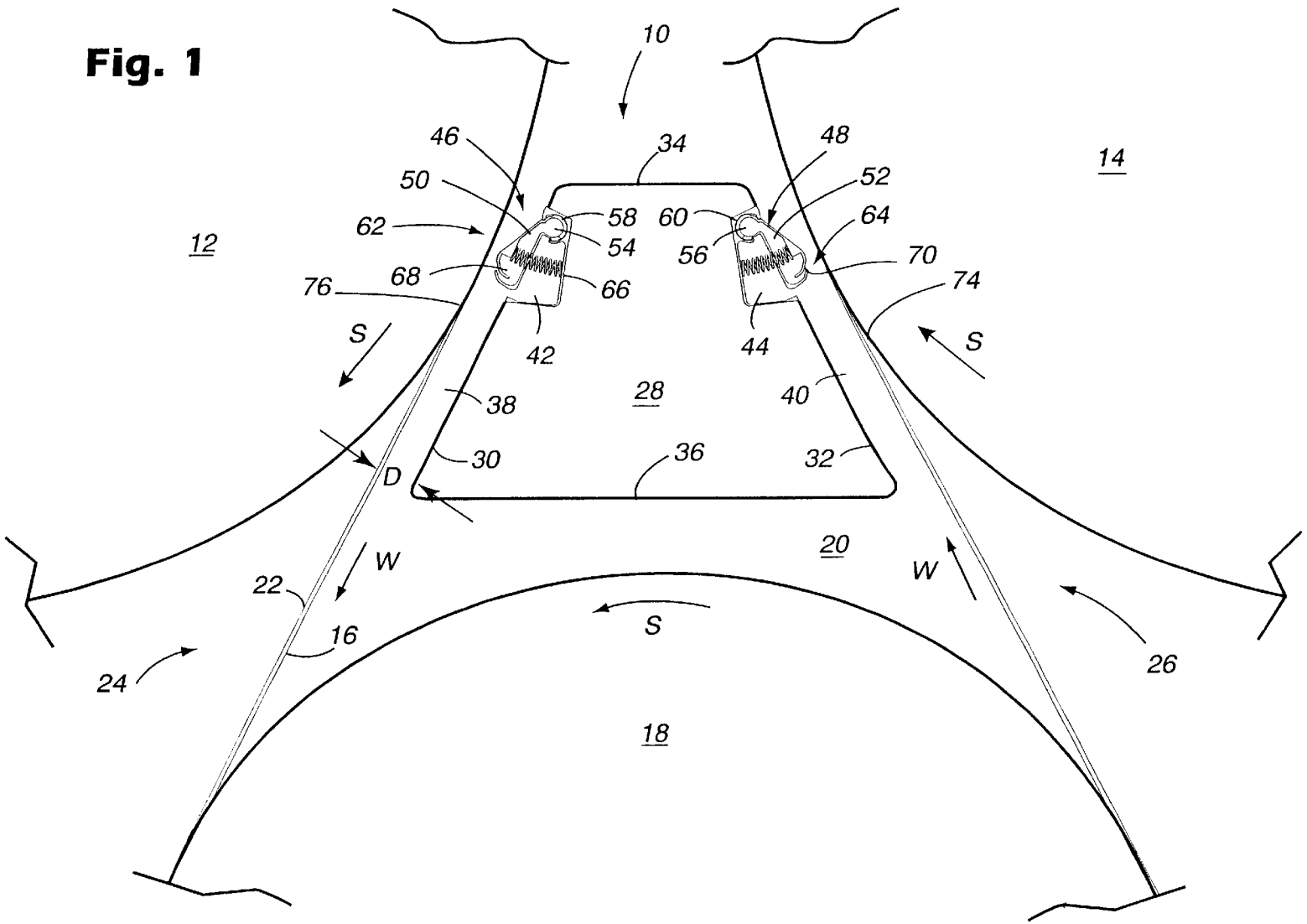
FIG. 1 is a diagrammatic vertical section in the machine direction of a blow box of the invention in a single-wire drying section, its sealing blow nozzles being in the normal operation position.
Figure 2:
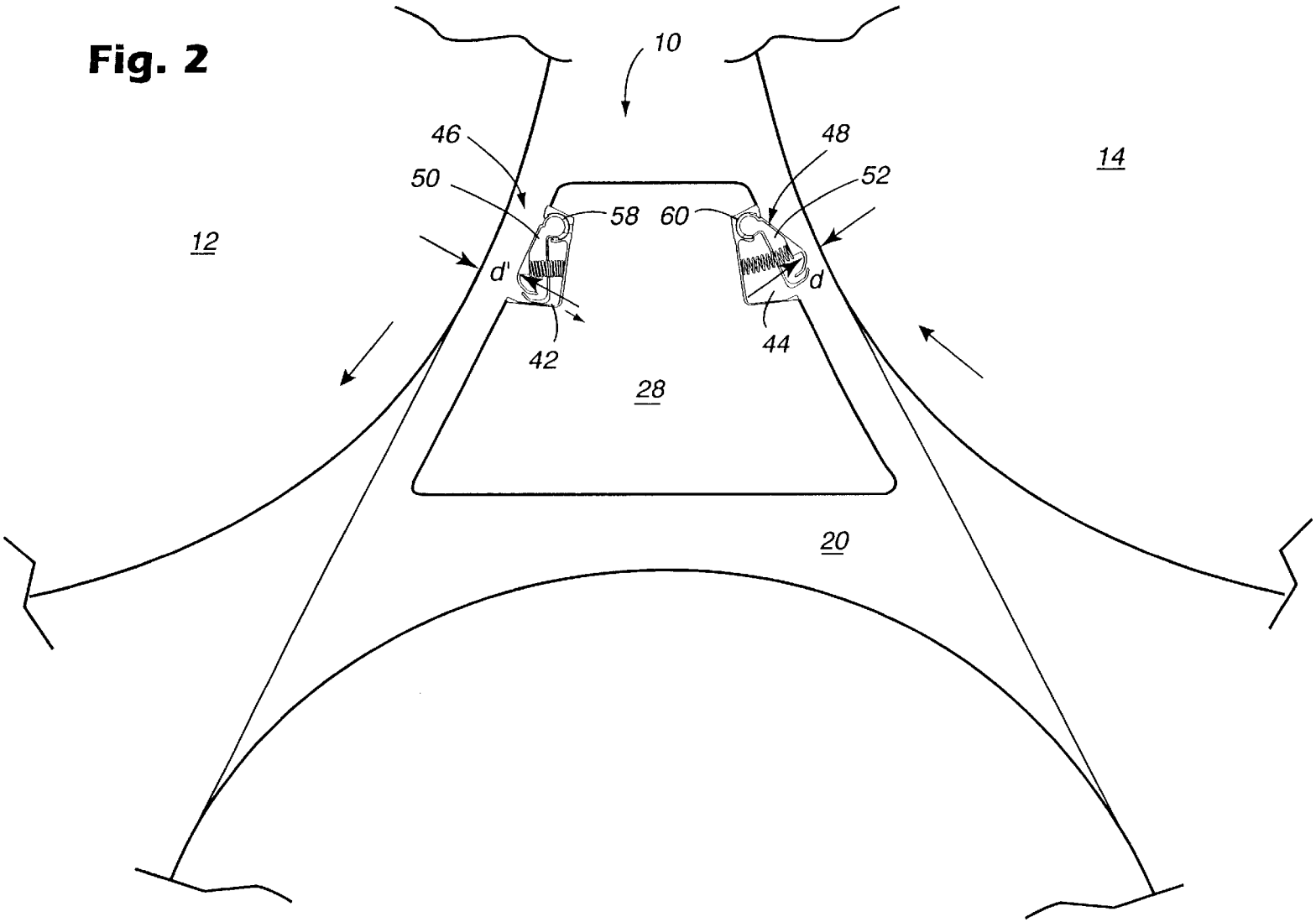
FIG. 2 shows the blow box of FIG. 1, one nozzle being pushed away from the wire.
Figure 3:
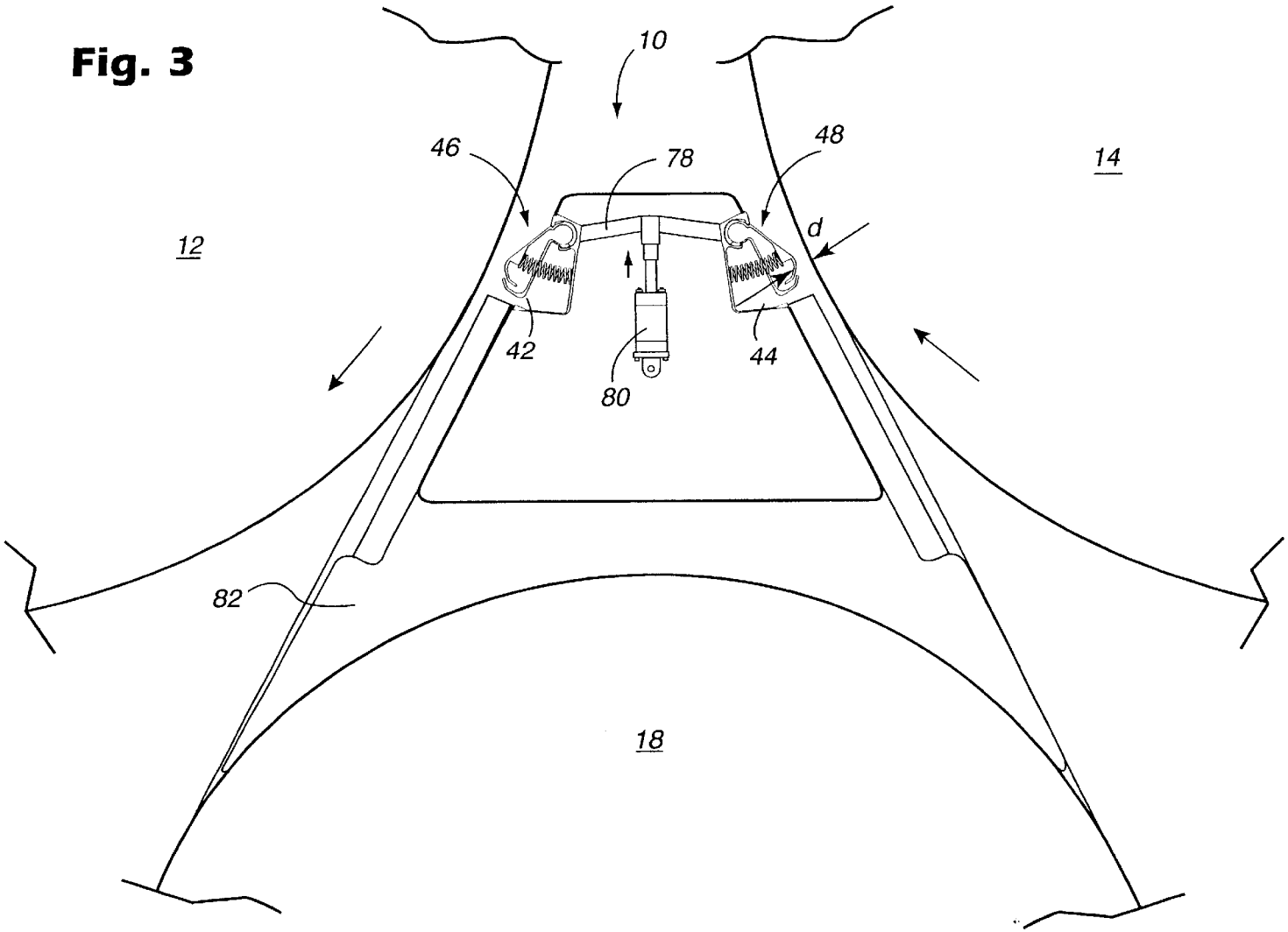
FIG. 3 is a diagrammatic view of the blow box of FIG. 1 seen from the side of the machine.

FIGS. 1, 2 and 3 show a blow box 10 of the present invention which is fitted into a pocket 20 formed by two drying cylinders 12, 14 of a single-wire drying section, a wire 16 and a turning cylinder or roll 18 below the drying cylinders and interlaced with the drying cylinders. The running directions of the drying cylinders l2, 14 and the wire 16 are shown with arrows S and W. The paper web 22 to be dried is transferred on the drying cylinder between the cylinder and the wire and, on the entry side of the wire run 24, it follows the wire towards the roll 18 over which the web 22 is transferred on the wire. The web follows the wire on the exit side 26 of the wire run from the roll towards the second drying cylinder 14, over which the web is transferred between the cylinder 14 and the wire 16.

The blow box 10 which is a so-called whole-pocket box, is fitted into the pocket (T) 20 so that it substantially fills the pocket space limited by two adjacent drying cylinders 12, 14, the turning cylinder 18 interlaced underneath and the wire runs 24, 26 for their part.

The blow box 10 comprises an air chamber 28 extending across the machine and limited by a wall 30 on the entry side of the wire, a wall 32 on the exit side of the wire, an upper wall 34 and a wall 36 facing the roll. The entry side 24 of the wire and the wall 30 limit between them a slot 38. Respectively, the exit side 26 of the wire and the wall 32 limit between them a slot 40. The walls 30 and 32 are at a distance "D" from the wire 16, which typically is about 50 mm.

Figure 5:
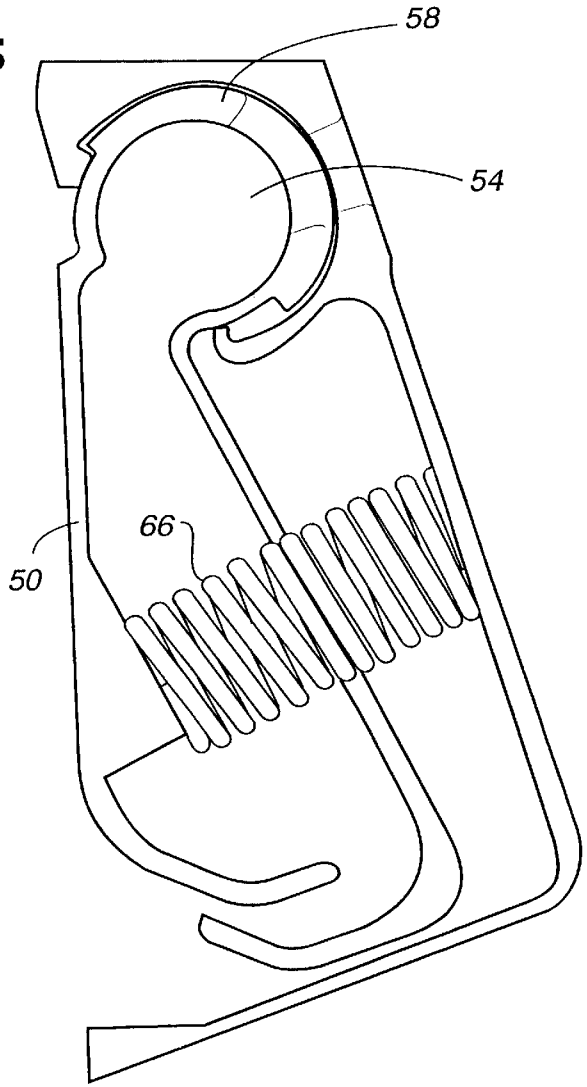
FIG. 5 shows the nozzle of FIG. 4 pushed away from the wire.

The walls 30 and 32 are provided with cavities 42 and 44 which are fitted with sealing and flexible sealing blow nozzles 46, 48. The nozzle 46 is shown enlarged in FIGS. 4 and 5. The nozzles 46, 48 comprise actual flexible actual nozzle parts 50, 52, the first ends 54, 56 of which are by links 58, 60 turnably attached to stationary frame parts 57 of the nozzle fitted into the cavities in the blow box. The links are provided with air inlet ducts 59 for leading air from the air chamber of the blow box to the air chamber 69 of the nozzle part. The nozzle parts 50, 52 ray be turned around the links 58, 60 so that the second end 62, 64 of the nozzle parts turns out from the cavity towards the wire 16. The nozzle parts are pushed by a spring 66, which is attached to the back wall of the cavity and which is open during normal operation, pushing the nozzle as close as possible to the wire. During normal operation, the nozzle parts 50, 52 are pushed towards the wire so that the distance "d" between the wire and the nozzle parts is about 3–15 mm (5–10 mm).

By fitting the nozzle as close as possible to the wire 16 travelling on the cylinder 12, the ejection effect of the blow may be increased. Thus, the underpressure effect of the blow on the wire run is intensified, e.g. at the opening nip of the wire and the cylinder 12 so that the paper web may better than before be held on the wire. The underpressure effect also prevents the web from becoming baggy in the opening nip of the cylinder 12. The increase in the ejection effect also leads to larger underpressure in the whole pocket and to the elimination of overpressure in the closing nip, which increased ejection effect holds the web more firmly on the wire.

The actual nozzle part 50, 52 is provided with blow apertures 68, 70, through which ejection air is blown diagonally upwards in the slot 38, 40 from the internal air chamber 69 of the nozzle, i.e. outwards from the pocket. The air blows are thus used for ejecting air away from the pocket 20, especially from the pocket areas on the entry and exit sides of the wires. From the chamber space 28 of the blow box, air is blown through the nozzles 46, 48 for generating the desired ejection effect.

The surface 72 of the actual nozzles 50, 52 turning towards the wire is convex. The nozzle is connected to the blow box so that the wire passes the nozzle in the area of the curved surface. In the nozzle of FIGS. 1–5, the nozzle apertures 68, 70 are located in the ultimate end of the curved nozzle part 50, 52 so that the wire does not hit the apertures even if it moves towards the nozzle. The nozzle apertures 68, 70 direct air along the convex surface 72, the so called Coanda surface, out of the underpressure zone in the pocket space.

On the entry side of the pocket space the nozzles are located a short distance upstream of the point at which the wire departs the first drying cylinder. On the exit side of the pocket space the nozzles are located a short distance upstream of the point at which the nip between the wire and the second drying cylinder closes. The air is thus preferably blown at a location about 50 mm from the detachment point 76 of the wire on the entry side and from the closing point 74 of the nip at the exit side.

The nozzles of FIGS. 1–5 show preferable flexible nozzle arrangements of the invention, with which the wire and the nozzle are prevented from becoming damaged as possible solid material travelling on the wire hits the nozzle.

Figure 4:
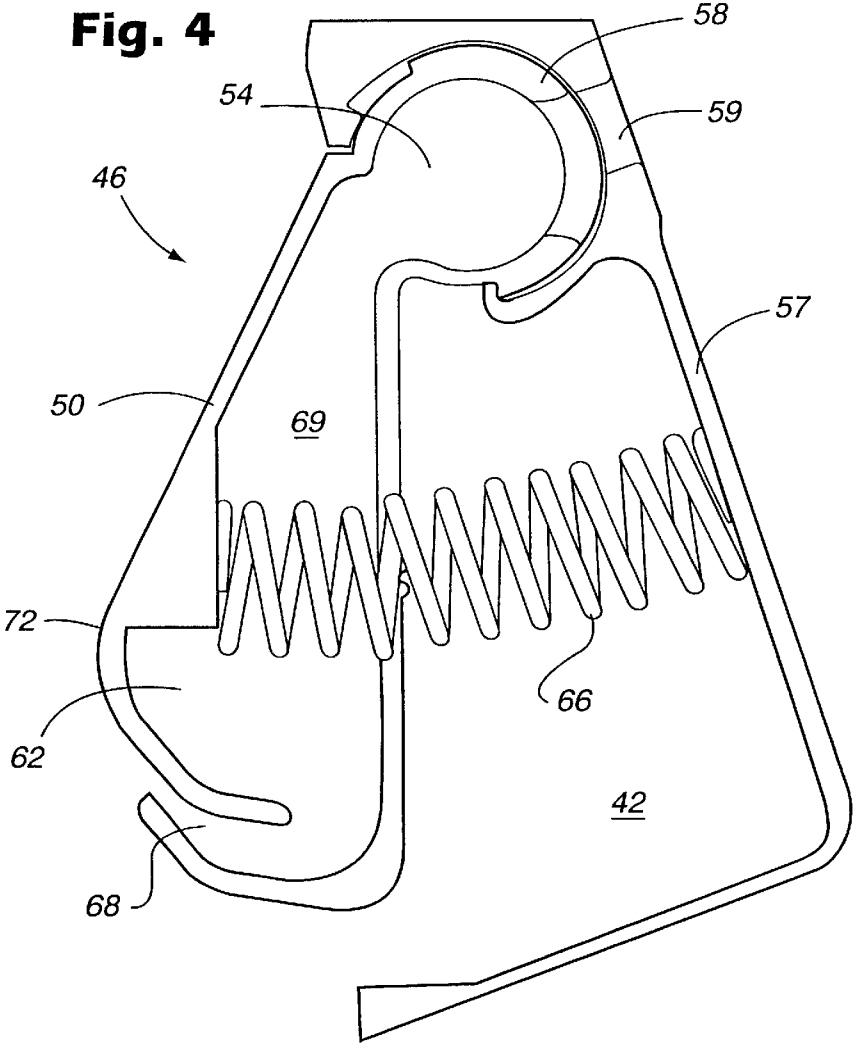
FIG. 4 is a diagrammatic vertical section of a sealing blow nozzle of the invention in the normal operation position.

FIG. 2 shows a blow box in which the nozzle 46 is turned to a withdrawn position around the link 58. The actual nozzle part, which in FIGS. 1 and 4 is in a so-called expanded state, i.e. protruding out from the cavity in the blow box, has in FIGS. 2 and 5 rotated around the link 58 towards the blow box 28 and retreated inside the cavity 42. The spring 66 is pushed back. Due to the force of a paper clod or the like, the nozzle may typically be compressed about 15 mm.

In the case shown in FIG. 2, the curved surface 72 of the nozzle 46 principally lies at the same safety distance, typically about 50 mm, from the wire as the wall 30 of the blow box so that paper clods or the like may pass between the cylinder 12 and the wire 16 without damaging the nozzle 46.

The nozzles may be turned by a passing clod, i.e. the clod may press the nozzle towards the blow box. On the other hand, the nozzles may be locked to the compressed state by a suitable actuator, for example, for the duration of tail threading. FIG. 3 shows a lever arm element 78 attached to the end of the blow box 10, and an actuator 80, with which the nozzles 46, 48 may be turned into the cavities 42, 44.

In the case of FIG. 1, the nozzles 46, 48 seal the border between the underpressure zone of the pocket 20 and the outside area so that the necessary underpressure may be maintained in the pocket by ejection blows. The slots between the wire edges, the edge areas of the blow box end and the edge zone of the roll may be sealed, for example, with fixed seals 82 shown in FIG. 3.

Figure 6:
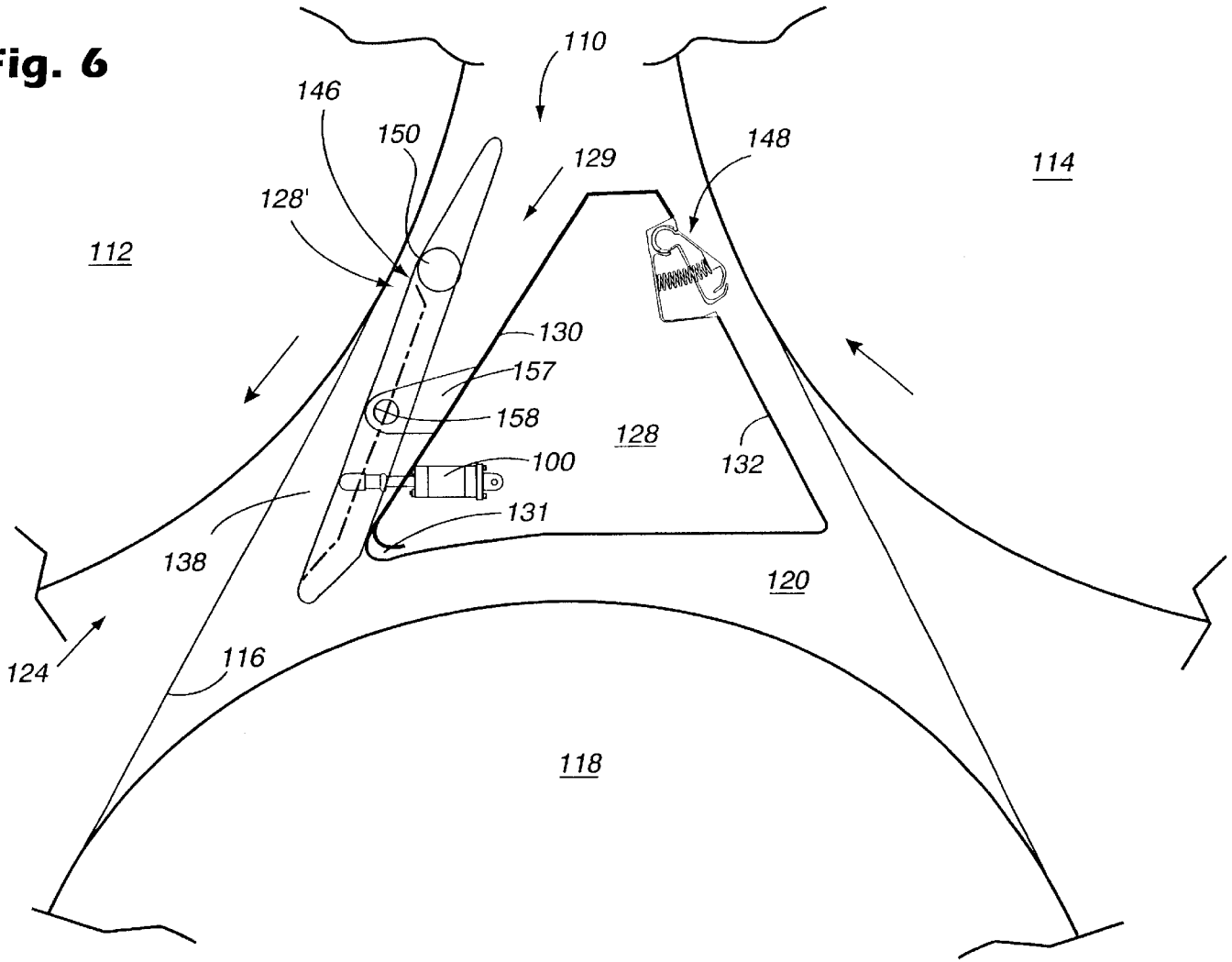
FIG. 6 is, in accordance with FIG. 1, a cross-section of a two-part blow box in its normal operation position.
Figure 7:
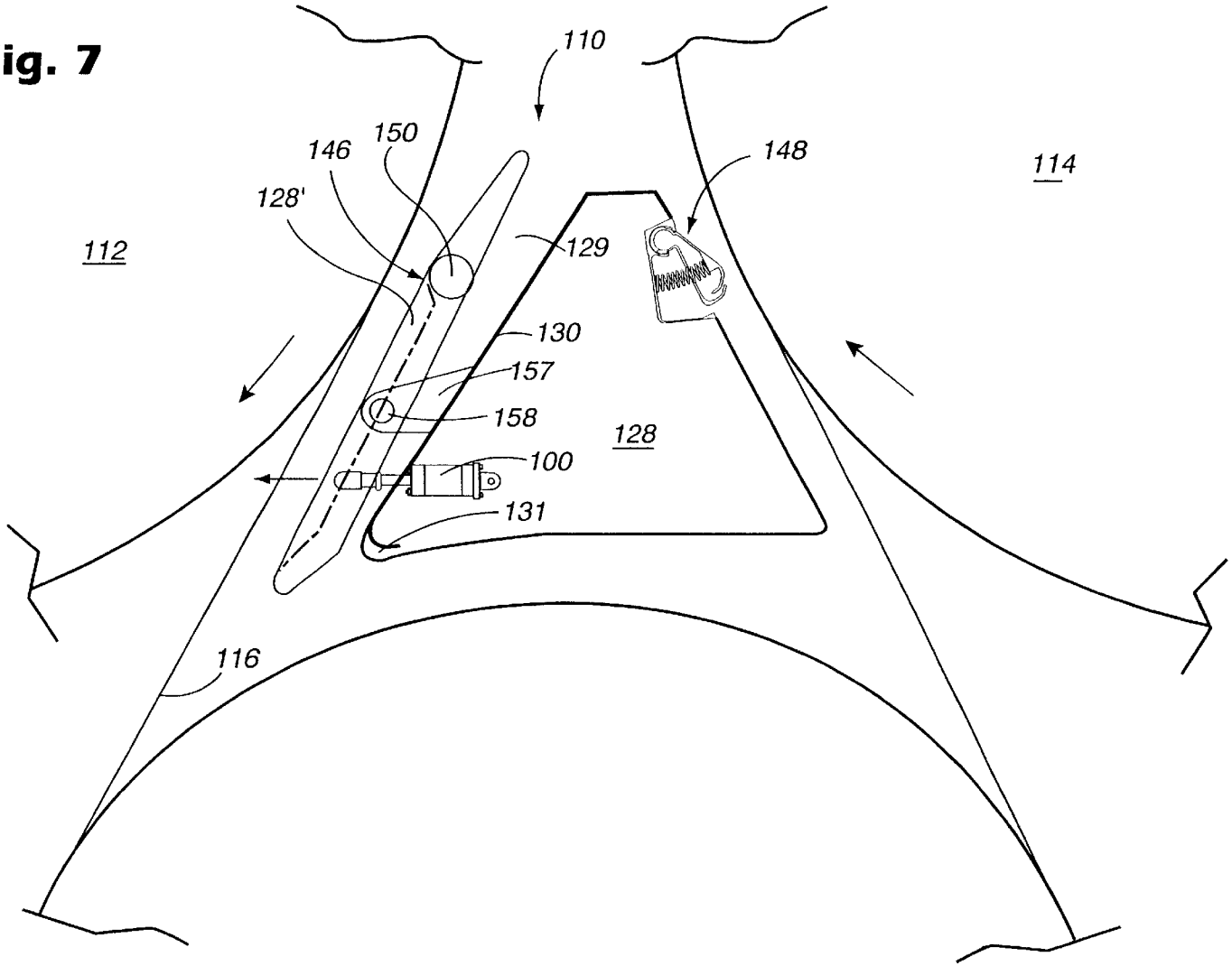
FIG. 7 shows the blow box of FIG. 6 in its position during tail threading.

In FIGS. 6 and 7, the same reference numbers are where applicable used as in FIGS. 1–5, however beginning with "1". FIGS. 6 and 7 show the blow box 110 of the present invention, consisting of two parts, a stationary main box 128 and a turnable auxiliary box 128'. The main box 128 comprises an air channel extending across the web and being of the same type as the air box 28 in FIG. 1. However, the wall 130 on the entry side of the wire run is situated at a longer distance from the entry side 124 of the wire 116 than in FIG. 1. A second, smaller auxiliary box 128' fitted onto the entry side 124 of the wire has a cross-section mainly in form of a wing or a vertical narrow box. The said narrow auxiliary box 128' is turnably connected to a fastening element 157 by a link 158, the said element 157 being fitted onto the wall 130 of the main box. Thus, a passage 129 is formed between the wall 130 and the wing-like auxiliary box 128'. A nozzle 146 and elements 145 extending across the web are fitted to the upper part of the auxiliary box 128' for leading air to the nozzle.

FIG. 6 shows a two-part blow box during normal operation. In this case, the lower part of the turnable auxiliary box 128' is turned into contact with the wall 130 of the stationary main box 128 so that the passage 129 between the auxiliary box and the main box is closed at its lower part. Thus, the auxiliary box 128' simultaneously forms a block for the nozzle 131 in the lower part of the wall 130 preventing air from flowing from the nozzle into the passage 129. The nozzle 146 of the auxiliary box 128' fitted to the upper part of the auxiliary box 128', i.e. above the link 158, is turned towards the wire to a distance smaller than the conventional safety distance so that the auxiliary box 128' itself forms the seal meant by the invention for the slot 138 between the auxiliary box and the entry side 124 of the wire 116. Air is blown from the nozzle 146 in the reverse direction of the running direction of the wire for ejecting air out of the slot 138. The structure of the wall 132 on the exit side of the wire run of the main box 128 in FIG. 6 is similar to the respective wall structure 32 with nozzles shown in FIG. 1.

The principle of this embodiment is that, by bringing the nozzle 146 closer to the wire run, it is possible to effectively affect the underpressure level generated by the box. In the arrangement of FIG. 6, the operation of the blow box is thus intensified by a turnable auxiliary box part in which the flexible nozzle closer to the wire surface further increases the necessary underpressure level.

In FIG. 7, the auxiliary box 128' has been turned clockwise around the link 158 by an actuator 100 compared with the situation in FIG. 6 so that the upper part of the auxiliary box 128' has moved farther away from the wire and, respectively, the lower part no longer is in contact with the wall 130, and both the slot 129 and the nozzle 131 blowing air into the slot are open. The position of the auxiliary box in FIG. 7 allows paper clods, etc. to travel past the blow box, for example, during tail threading. During tail threading, air may be ejected away from the pocket also through the passage 129 with the help of ejection blows from the nozzle 131.

During tail threading, in addition to reaching the underpressure level, it is also important to effectively remove air from the pocket space with the help of nozzles. For this reason, the box is designed to operate so that, during tail threading, air is removed as effectively as possible with the help of both the upper and lower ejector nozzles 146, 148, 131. When necessary or when desired, also the nozzles 148 and 131 in the main box may be operatively isolated from each other and combined with different air chambers which, however, are not shown in the figure. When tail threading is successfully completed, the auxiliary box is turned anticlockwise by the actuator 100 so that, during normal operation, as powerful an underpressure effect as possible is achieved. When the auxiliary box is thus turned to contact the main box, the flow of air through the lower nozzle 131 of the main box is cut. Turning the box to the tail threading position may be done using the automatics of the papermaking machine.

If desired, the described arrangement may also be realized so that both boxes are turned; in that case, the distance of both upper nozzles 146, 148 from the wire surface may be adjusted for generating the necessary underpressure effect.

With this arrangement of the invention, the intention is to intensify the operation of the blow nozzle box by optimizing the nozzle geometry of the blow box and by providing a center blow at an optimum location. The operation of the box is especially intensified by decreasing the angle between the nozzle 146 and the wire 116. In this case, the blow more effectively prevents the inflow of a boundary air layer along the wire from the first drying cylinder to the box space. The operation of the nozzle 146 on the entry side is crucial for the operation of the box; therefore, the amount of air flowing from the nozzle has to be large enough in order to prevent the effect of the boundary air layer flowing along the wire. on the exit side, the operation of the nozzle 148 is assisted by the wire surface removing air from the pocket space and operating, like the nozzle, as an active part in removing air.

In some embodiments, the nozzle 148 on the exit side may be replaced by a flexible mechanical seal, disposed close to the wire surface, however, without touching it.

Figure 8:
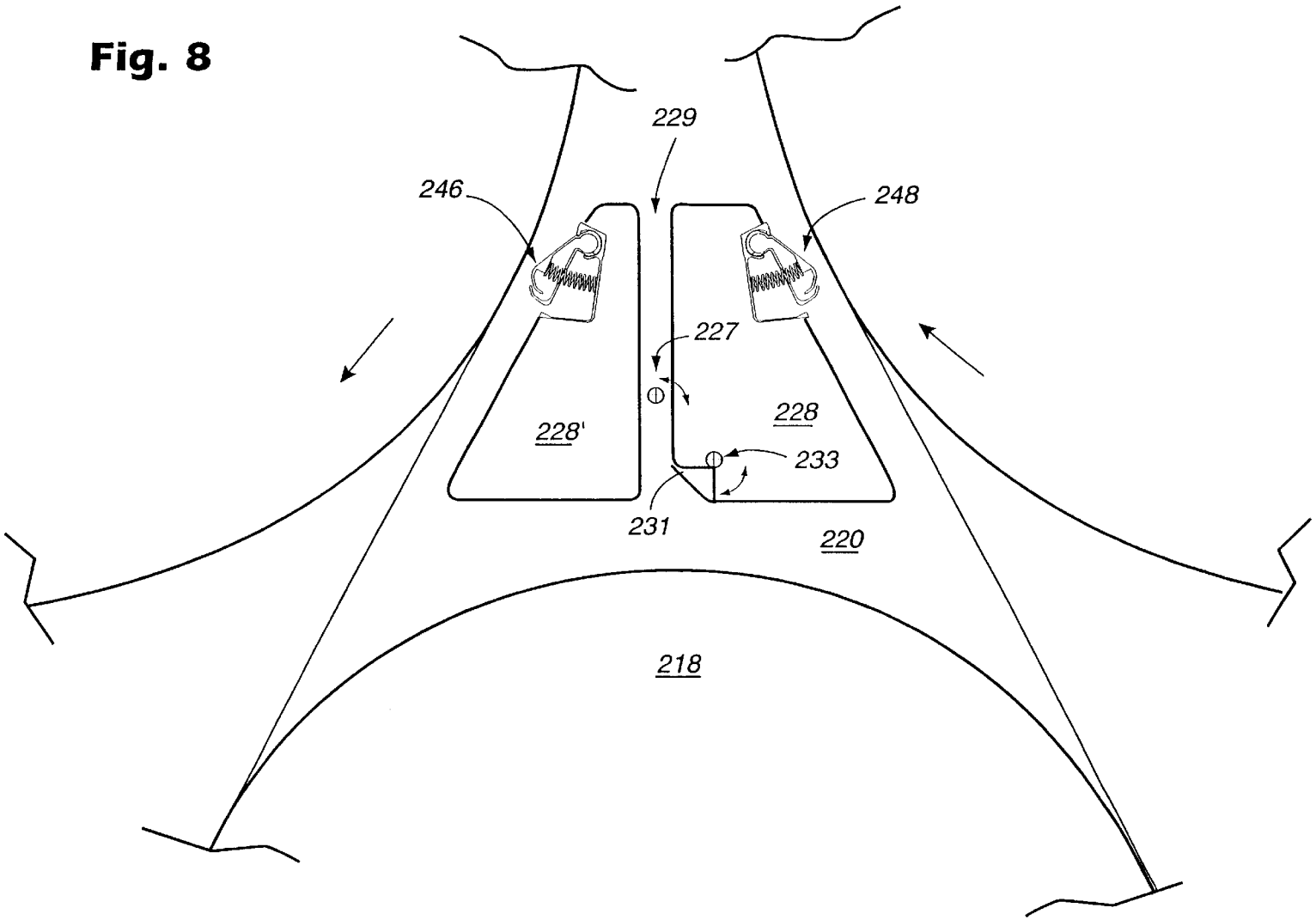
FIG. 8 shows, in accordance with FIG. 6, a cross-section of a two-part blow box of the invention.

FIG. 8 shows another embodiment of a two-part blow box of FIG. 6. In FIG. 8, the same numbers are where applicable used as in FIGS. 1 and 6, however beginning with "2". The box consists of two stationary main boxes 228 and 228' which principally are mirror images of each other. The passage 229 inbetween may be closed with a closing element 227. At the beginning of the passage 229, the lower part of the main box 228 is provided with a nozzle 231, which may be closed with an element 233. The walls of the main box facing the wire are provided with sealing blow nozzles 246, 248 of FIG. 3. In FIG. 8, the two-part blow box is shown during normal operation; the nozzles 246, 248 are then in a sealing position protruding outwards, and the passage 229 between the boxes and the nozzle 231 is closed.

For the duration of the tail threading process, the nozzles 246, 248 may be pulled away from the wire, using an actuator in accordance with FIG. 3 (not shown in FIG. 8). At the same time, air removal from the pocket 220 may be intensified by opening the passage 229 between the boxes, which is closed in FIG. 8, and by ejecting air away through the passage with the help of blows from the nozzle 231, which is closed in FIG. 8.

An advantage of the two-part blow boxes of FIGS. 6, 7 and 8 is also that, due to their two-part structure, they may more easily be installed into narrow locations.

The arrangements shown in FIGS. 1–3 and 6–8 may especially be used also in situations in which it is, for some reason or another, not possible to maintain/reach normal suction effect in the turning roll 18, 118, 218, and in which, for some reason, especially high underpressure levels are required in the rolls, or if it is otherwise desirable to increase the underpressure level of the roll with the help of the blow box.

Figure 9:
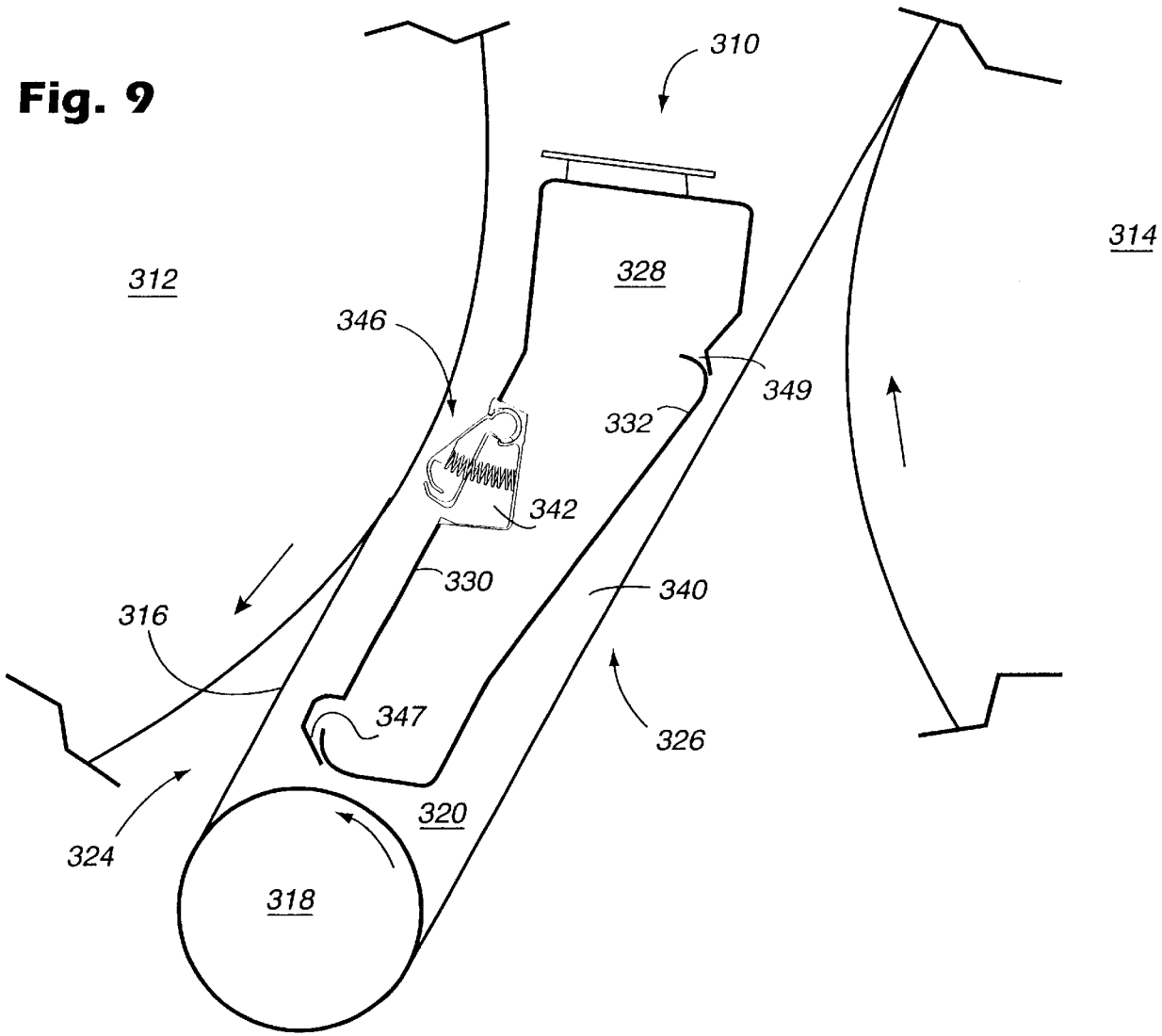
FIG. 9 shows, in accordance with FIG. 1, a section of a blow box of the invention in a twin-wire drying section.

In FIG. 9, the same reference numbers are where applicable used as in FIGS. 1 and 6, however, beginning with "3". FIG. 9 shows a blow box 310 of the invention in a twin-wire drying section. The blow box is fitted into a so-called wire pocket 320 limited by two drying cylinders 312, 314, a wire 316 and a turning roll 318. The blow box 310 comprises a stationary box structure 328 extending across the web. The wall 330 on the entry side 324 of the wire run is provided with a nozzle 346 similar to the nozzle 46 in FIG. 1, and a nozzle 347 blowing against the direction of the roll 318 is provided in the lower part of the blow box for ejecting air away from the space between the blow box and the entry side of the wire. The opposite wall 332 of the blow box is again fitted with a nozzle 349 which blows air towards the slot 340 between the blow box and the exit side of the wire run, thus generating ventilation of the slot. The nozzles 346, 347, and especially 349, may operatively be isolated from each other.

The ejection nozzle 346 is flexibly attached to a cavity 342 of the blow box, like the nozzles 46 and 48 in the embodiment of the invention shown in FIG. 1. The nozzle. 346 is thus flexible and allows a paper clod to push its way through the slot between the cylinder and the nozzle without damaging the wire or the nozzle. The nozzle may also be pushed away from the wire for a desired time, using a lever mechanism shown in FIG. 3, or by some other respective way.

Figure 10:
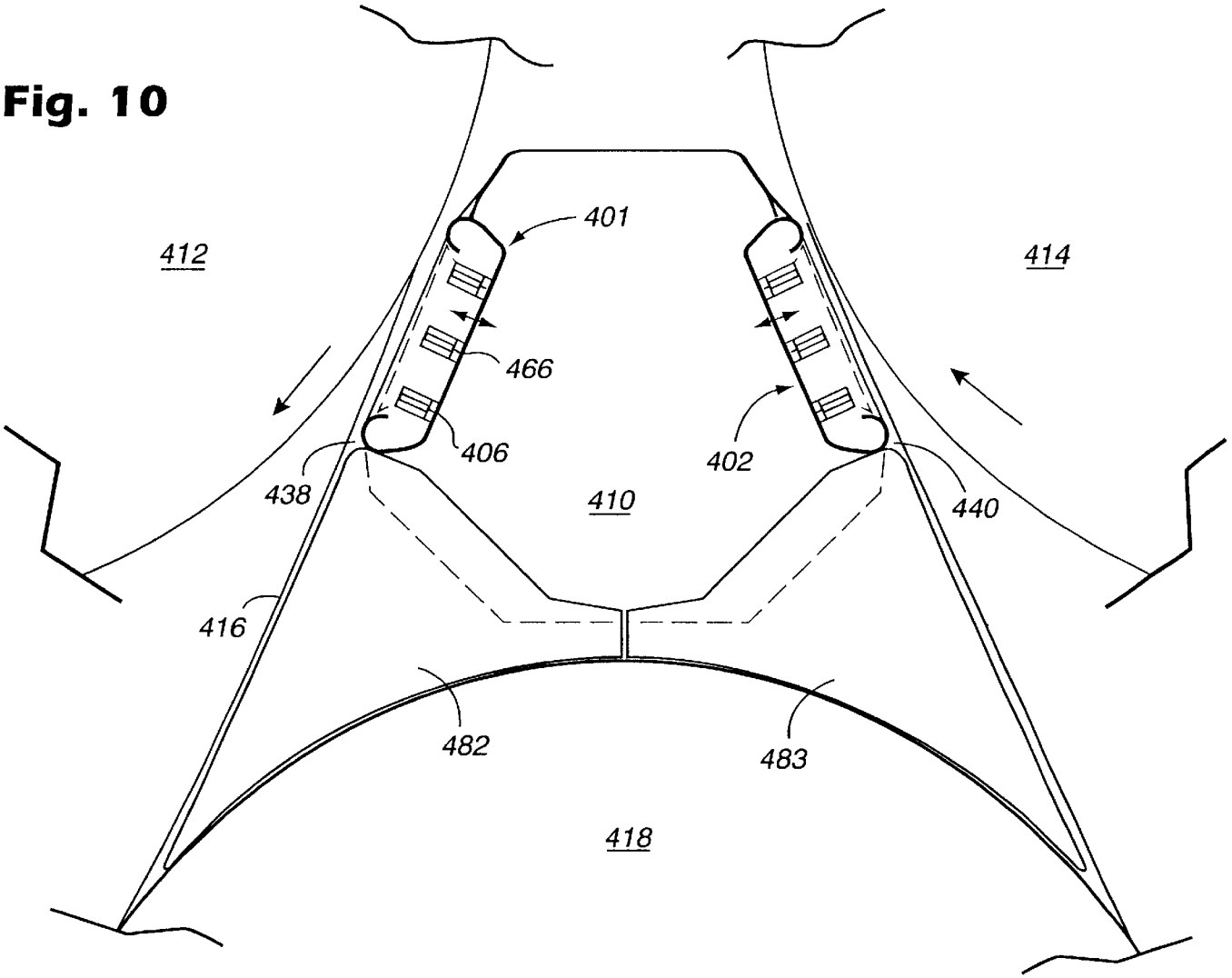
FIG. 10 is a diagrammatic view of a blow box provided with edge seals of the invention, seen from the side of the machine.

In FIGS. 10–15 showing an edge seal of the invention, the same reference numbers are where applicable used as in FIGS. 1–5, however, beginning with "4". FIG. 10 thus shows a blow box 410 fitted into the pocket between the cylinders 412, 414, a turning roll 418 and a wire 416. The edge zones of the blow box ends have in the running direction of the wire flexible edge seals 401, 402 near the nip between the wire and the cylinders 412, 414; the purpose of the seals being to seal the slots 438, 440 between the edge zones of the blow box and the edge of the wire for maintaining the underpressure zone between the blow box and the wire effective also in the edge zones. The edge seals 401, 402 are provided with ejecting blow nozzles. In FIG. 10, there may also be seen fixed mechanical seals 482, 483 fitted to the blow box, sealing the end part in the area between the end of the turning roll and the blow box.

Figure 11:
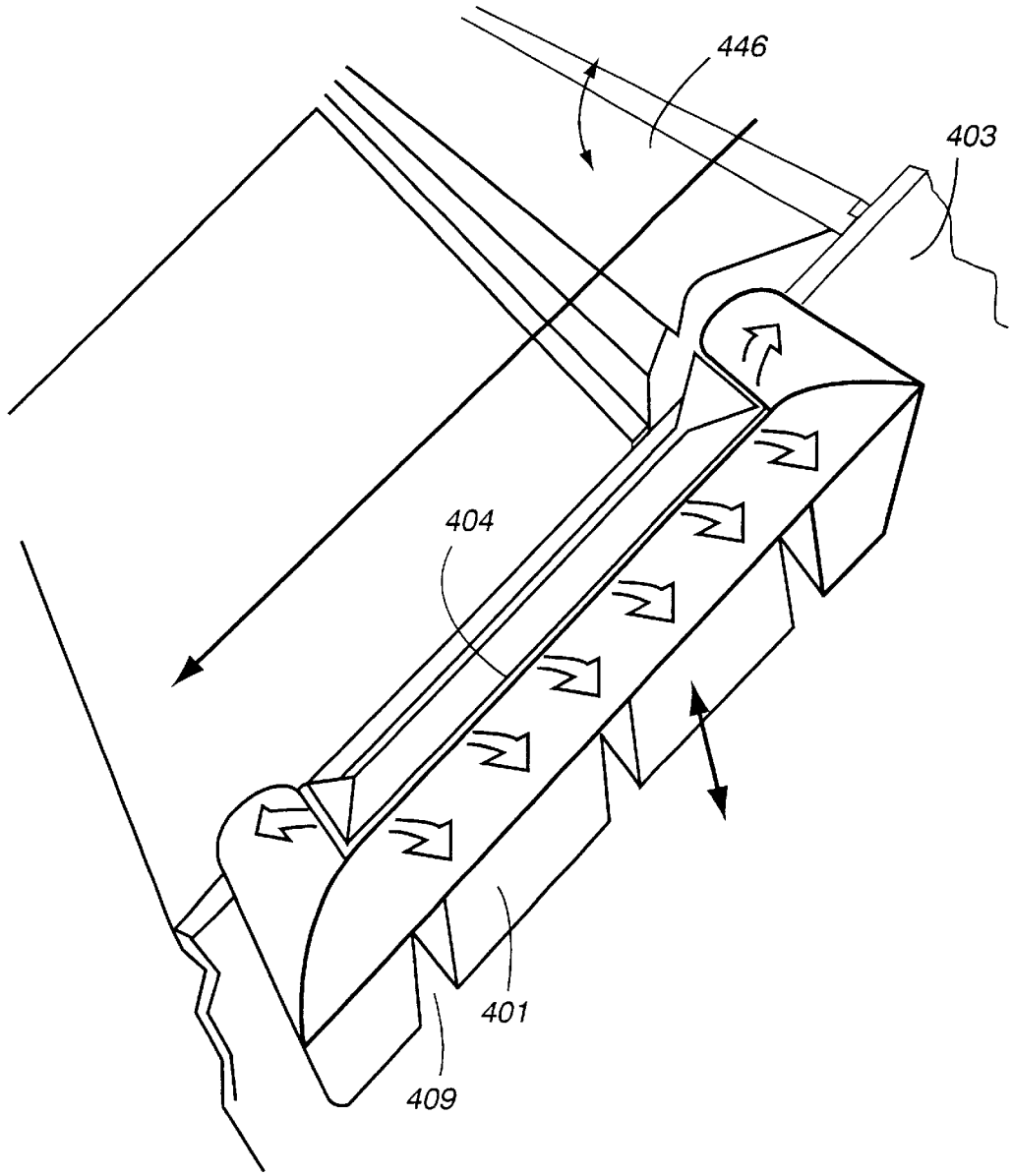
FIG. 11 shows an edge seal of FIG. 10 diagonally from above.

FIG. 11 shows a section of the flexible blow box 410 with a mechanical seal 446 extending across the web and an edge seal 401 fitted onto its end wall 403 at the slot between the blow box and the wire, in accordance with FIG. 10. The edge seal contains nozzles 404 for blowing ejection air outwards from the nozzle slot of the seal to maintain underpressure in the slot between the blow box and the wire also in the area of the wire edge.

Figure 12:
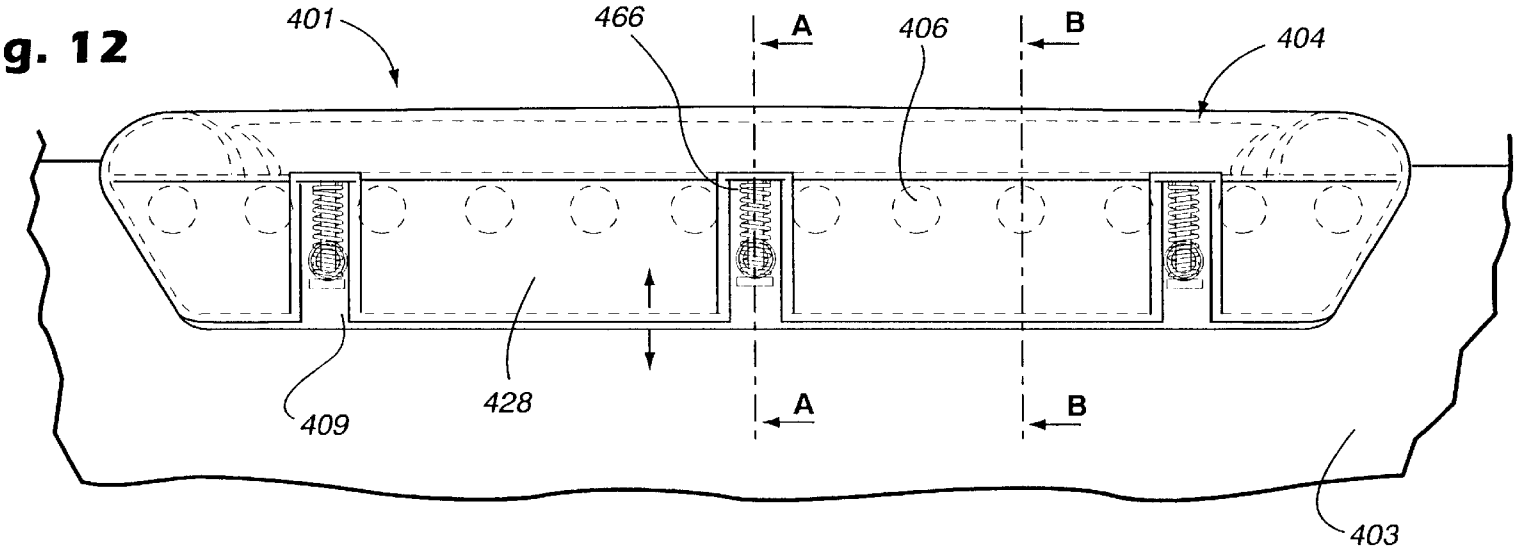
FIG. 12 is a longitudinal section of an edge seal of FIG. 10.
Figure 15:
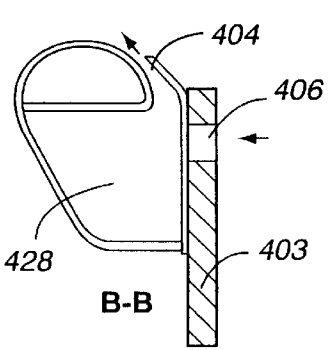
FIG. 15 is a cross-section of FIG. 12 at B—B during normal operation.
Figure 14:
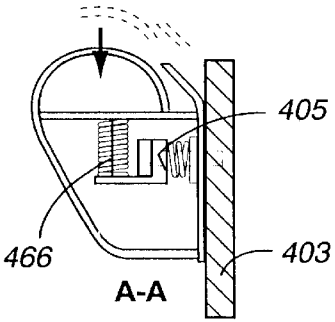
FIG. 14 shows a cross-section of FIG. 12 at A—A as a paper clod or some other obstruction is pressing the seal.
Figure 13:
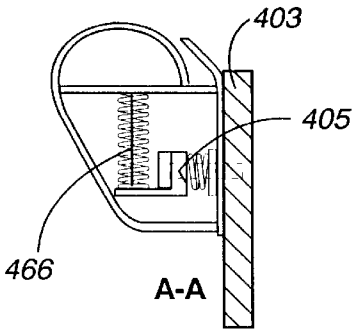
FIG. 13 is a cross-section of FIG. 12 at A—A during normal operation.

The structure of the edge seal 401 shown in FIGS. 10 and 11 is depicted in FIGS. 12–15. FIG. 12 shows a longitudinal section of the edge seal 401. FIGS. 13 and 14 show a section of the edge seal along the line A—A of FIG. 12, and FIG. 15 shows a section along the line B—B. The edge seal comprises an elongated flexible chamber structure which is slidably fastened to fastening elements 405 fitted firmly onto the end wall 403 of the blow box so that, by pressing the edge seal, the chamber may be slidably pushed away from the wire, in the direction of the end wall in relation to the fastening elements, i.e. from the position of FIG. 13 to the position of FIG. 14. The edge seal is provided with a spring 466 which returns the edge seal to the normal operation position as the pressing has stopped. The springs 466 are fitted into cavities 409 formed into the air chamber of the edge seal. FIG. 13, taken at the cavity containing the spring, and FIG. 15, taken at the air chamber, show a cross-section of the edge seal in the normal operation position. FIG. 14 shows the edge seal pressed, along the surface 403 of the end wall and away from the wire, against the force of the spring 466.

Apertures 406 are provided through the air chamber 428 of the edge seal and the end wall 403 for leading air from the air chamber of the blow box into the air chamber of the edge seal.

In FIG. 16 to 18 same reference numerals have been used as in FIG. 1 where applicable, however, beginning with a "5". FIGS. 16 and 17 show a sealing means 546 according to the present invention. The sealing means is connected to a blow box (only a small part of its side wall 530 shown in FIG. 17) and includes a stationary actual nozzle element 551 and a sealing element 553. The sealing element 553 is connected in its first end 550 by a link mechanism 558 to a stationary frame construction 557 fitted to the blow box wall 530. The sealing element is turnable around the link. The link is located upstream of the point at which the wire and the web depart from the drying cylinder. The second end 562 of the sealing element 553 reaches at normal operation to the nozzle element 551. A curved convex middle portion of the sealing element protrudes towards the wire.

Air is to be blown from the nozzle element 551 in the opposite direction of the direction of the web and the wire 516, as shown with arrows a and w. The air will flow smoothly along the curved so called Coanda surface of the actual sealing element 553 and eject air out of the pocket space formed between the blow box wall 530 and the wire 516. The air blown through the nozzle 551 will also form a counterflow against the boundary air flow b following the wire and attempting to flow into the pocket space, and thus prevent or minimize such flow into the pocket space.

The separate sealing element 553 may be a flap of plate material, typically about 0.1 to 0.2 m long in the running direction of the wire. The flap may be rather light in its construction and can therefore easily be moved away from the wire towards the blow box, by e.g. a paper clod. A sealing element made of plate material is easy to assemble and to remove from the blow box.

The nozzle element 551 is positioned in the blow box 50 that the nozzle opening 568 will, at all operating conditions, be located at a safety distance "D" from the wire, so that normally no objects 590 travelling with the wire will damage the nozzle opening. The sealing element 553, on the other hand, is normally protruding to a point very close to the wire, in order to provide an effective sealing of the underpressure zone. Objects 590 possibly travelling between the wire and the web may press the sealing element 553 towards the blow box to a distance almost as far from the wire as the nozzle 551, as is shown in FIG. 17. The sealing element forms a shield in front of the nozzle. A torsion spring 566 will push the sealing element 553 back towards the wire as soon as the object 590 has passed by. A torsion spring causes a more even counterforce than the spring shown in FIG. 4. The air flow from the nozzle 551 will form a cushion between the sealing element and the wire and prevent the wire from contacting the sealing element even when an object passes. The pressing of the sealing element towards the blow box will not affect the size of the blow nozzle opening 568 or the air flow.

In order to get a smooth air flow along the Coanda surface of the sealing element 553, the nozzle opening 568 may be formed as shown in FIG. 18. The first and second lips 592, 594 of the opening are formed so as to guide the air flow as smoothly as possible onto the sealing element. The first lip may have a wedge or similar shaped form, as shown in FIG. 18, so as to be able to guide the flow as close to the sealing element 553 surface as possible. The surface of the first lip 592 thus forms a smooth extension of the Coanda surface of the sealing element, smoothly forwarding air and preventing or minimizing turbulence in the flow between the nozzle and the sealing element. In this case the second lip 594 is 0–10 mm, typically 5–7 mm shorter than the first lip and does therefore not protrude closer to the wire than the first lip. Thus the sealing means as a whole can be disposed very close to the wire, which is advantageous for creating the flow along the Coanda surface of the sealing element. Underpressure may be achieved with lesser energy. The movement of the sealing element 553 may be controlled. The final end tip 553' of the sealing element 553, shown in FIG. 16, is formed so as to, in its normal operation position, lay against the nozzle, the nozzle thus preventing the sealing element from turning too far towards the wire. The sealing elements of the present invention may additionally be controlled by control elements connected to the link mechanisms 58, 558. The control elements may control or restrict the turning of the sealing element. As the distance "d" between the sealing element and the wire can be controlled, also the flow of air flowing along the Coanda surface and in the slot can be controlled. It may also be possible to completely withdraw the sealing element from the slot e.g. during tail threading.

Figure 19:
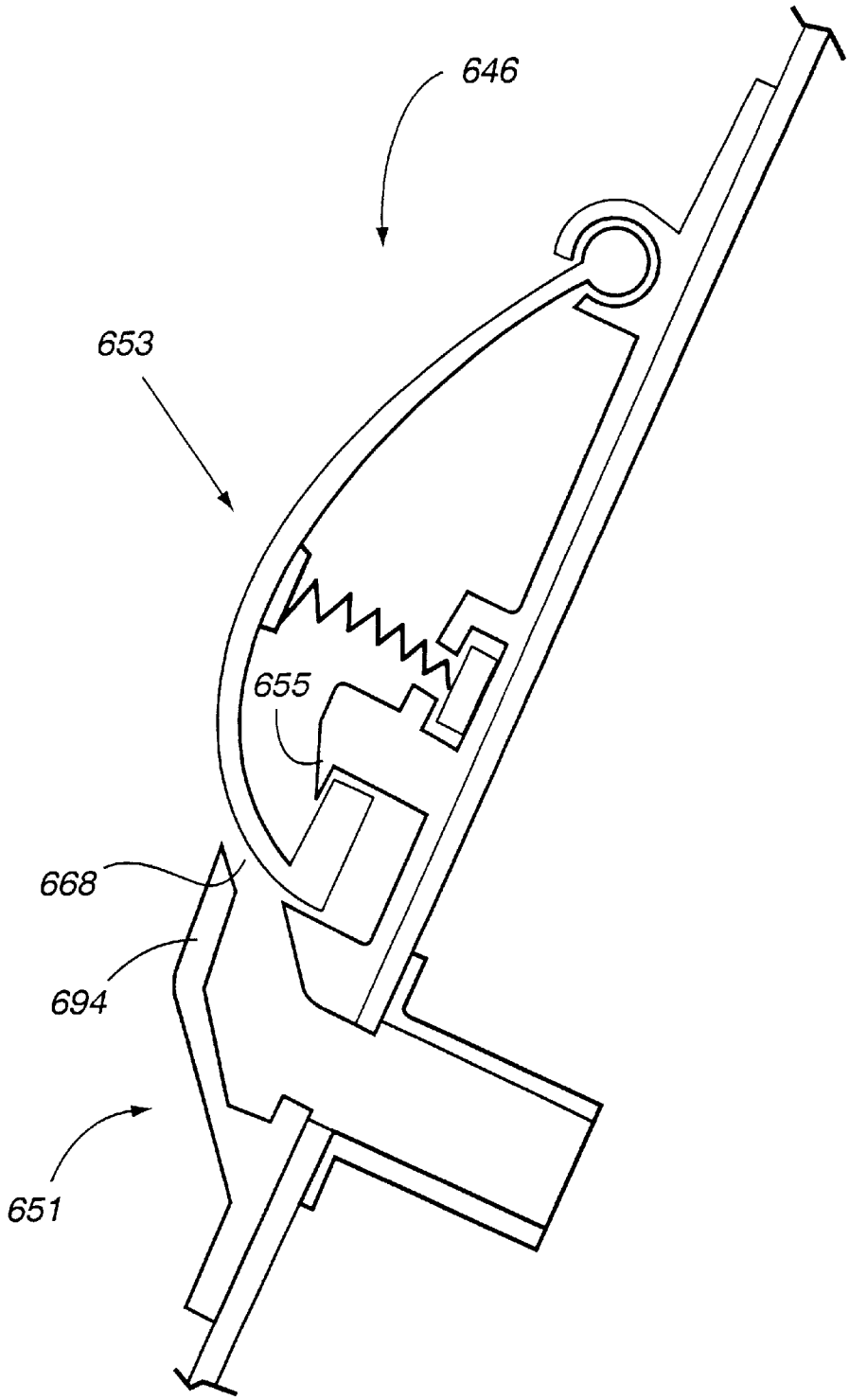
FIG. 19 is a diagrammatic vertical section of still another embodiment of a sealing means.

FIG. 19 shows a still further embodiment of a sealing means according to the present invention. same reference numerals as in FIG. 1 will be used when applicable, however, preceded by a "6". The sealing means 646 includes a stationary nozzle part 651 and a turnable sealing element 653, having a Coanda surface. The sealing element is mainly of the same type as the one shown in FIG. 16. An obstruction 655 is disposed in the sealing means for restricting the movement of the sealing element, particularly preventing the sealing element from protruding too far towards the wire, i.e. protruding longer than the desired final position.

In the actual nozzle element 651 a nozzle opening 668 is formed between the end of the second lip 694, which is arranged to reach close to the surface of the sealing element 653, and the surface of the sealing element. The air discharged from the nozzle will then be guided to flow smoothly onto the Coanda surface of the sealing element.

Using the blow box and method of the invention, it is possible, with the help of the ejecting blows and the sealing element to intensify the underpressure zone formed into the pocket between the drying cylinders, the wire and the turning roll, for improving the operation of the papermaking machine. With the underpressure effect, it is possible to support the running of the web, avoid breaks and the web from becoming baggy. It has also been noticed, that holding the web firmly on the wire (e.g. with a pressure of 1000 Pa) on the runs between the drying cylinders, decreases the transverse shrinkage of the web.

The invention has above been explained referring to preferred exemplary embodiments; but the invention is by no means intended to be restricted to these details only. Many modifications are possible within the inventional idea defined in the following claims.

The blow box described above may thus be applied in a papermaking machine or a similar device elsewhere than in the pockets described above. When necessary, the blow box or a similar part may be fitted in connection with some supporting fabric to a distance "D" from the supporting fabric for ejecting air away from the space between the supporting fabric and the blow box and/or for preventing air from flowing from outside the said space into the said space. The blow nozzle may, in this case, be joined to the stationary frame part in the blow box, or a similar part, using a link or some other similar element allowing movement. In accordance with the invention, the actual nozzle part is then arranged to be held at a distance "d" from the supporting fabric, either by a spring or some other similar element, the distance "d" being shorter than the distance "D". The spring or a respective element allows the actual nozzle part to move away from the supporting fabric to a distance "d'" from the supporting fabric by a push directed to the nozzle part and/or by an actuator, the distance "d'" being larger than the distance "d".

The nozzle of the invention may thus be used for sealing the underpressure zone also in the area of the supporting fabric edges and, when necessary, even in the area of the turning roll.

What is claimed is:

1. A drying section of a papermaking machine blow box assembly comprising:

first and second drying cylinders for drying a moving web, and a wire for transporting the web running from said first cylinder to said second cylinder;

a turning element, said wire passing around said turning element between said drying cylinders;

a blow box positioned within a pocket defined by said cylinders, turning element, and wire within the papermaking machine drying section, said blow box ejecting air from said pocket and at least one of generating and maintaining an underpressure zone in at least part of said pocket;

an interface between said underpressure zone and a volume outside said underpressure zone;

at least one sealing element which has at least a portion which projects from said blow box toward said wire to a point a distance d from said wire, and which forms a seal between said underpressure zone and said outside volume at said interface including by blowing air from said blow box toward said wire; and said at least one sealing element connected to said blow box so that said at least a portion thereof may be moved away from said wire a distance d' which is greater than d.

2. A blow box assembly recited in claim 1 wherein said at least one sealing element comprises a sealing blow nozzle articulated to said blow box by a link, said nozzle movable with said at least a portion of said sealing element.

3. A blow box assembly recited in claim 2 further comprising an actuator for moving said blow nozzle so that said at least a portion thereof moves between said distances d and d'.

4. A blow box assembly recited in claim 2 wherein sealing element has a free end with a convex surface, and wherein said air nozzle is formed by an outlet channel in said sealing element positioned with respect to said surface so that air from said air nozzle flows smoothly along said convex surface.

5. A blow box assembly recited in claim 2 wherein sealing element has a free end with a Coanda surface, and wherein said air nozzle is formed by an outlet channel in said sealing element positioned with respect to said surface so that air from said air nozzle flows smoothly along said Coanda surface.

6. A blow box assembly recited in claim 1 wherein said at least one sealing element comprises a plurality of sealing blow nozzles extending sequentially across the width of the moving web to be dried supported by said wire.

7. A blow box assembly recited in claim 1 wherein said sealing element comprises at least one stationary nozzle which blows air from said blow box toward said wire.

8. A blow box assembly recited in claim 1 wherein said wire comprises first and second wires, defining a twin-wire drying section.

9. A blow box assembly recited in claim 1 wherein said wire moves in a running direction into said pocket; and wherein said sealing element includes a first nozzle which blows air from said blow box in a direction opposite to the wire running direction so as to substantially prevent air from being transported into said pocket with said wire.

10. A blow box assembly recited in claim 9 wherein said wire comprises first and second wires, defining a twin wire drying section; and wherein said turning element comprises a turning roll; and wherein said blow box comprises a second nozzle adjacent said turning roll for blowing air against said turning roll to eject air from said underpressure zone past said turning roll.

11. A blow box assembly recited in claim 1 wherein d is between 3–15 mm, and wherein d' is between about 20–30 mm.

12. A blow box assembly recited in claim 1 further comprising a spring for biasing said sealing element so that said sealing element is at said point a distance d from said wire.

13. A blow box assembly recited in claim 12 wherein said sealing element may be moved against said spring bias by an object moving past the sealing element, and wherein said distance d'>50 mm.

14. A blow box assembly recited in claim 1 wherein said blow box comprises first and second spaced blow box components, each component having at least one said sealing element therein; and a blow nozzle for blowing air through a space between said blow box components for ejecting air out of said pocket to maintain underpressure in said underpressure zone.

15. A blow box assembly recited in claim 14 wherein said wire has an exit side, and wherein said first component is on said wire exit side and a stationary main blow box structure extending across the web, and said second component comprises a wing-shaped structure turnably articulated to said first component and extending across the web, said second component having a smaller average cross-sectional area than said first component.

16. A blow box assembly recited in claim 14 wherein said first and second components are identical mirror images of each other; and further comprising a movable closing element for selectively closing said space between said blow box components.

17. A blow box assembly recited in claim 1 further comprising a cavity defined in said blow box; and wherein said sealing element is mounted in said cavity so that at least a portion thereof is movable into and out of said cavity.

18. A method of sealing a pocket defined by a wire running between first and second drying cylinders and a turning element in a drying section of a papermaking machine, the pocket including an underpressure zone at least one of generated or maintained by a blow box, and an interface provided between the underpressure zone and a volume outside the underpressure zone, said method comprising:

(a) sealing the interface using at least one flexible sealing element having at least a portion thereof projecting from the blow box toward the wire to a point a distance d from the wire, and movable to a distance d' from the wire where d'>d; and (b) blowing air through the at least one sealing element toward the wire so that the air is ejected from the pocket and at least one of generates and maintains underpressure in the underpressure zone.

19. A method as recited in claim 18 further comprising (c) moving the sealing element at least one portion between the points spaced d and d' using an activator.

20. A method as recited in claim 19 wherein the sealing element is a sealing blow nozzle, and wherein (c) is practiced to turn the nozzle toward the blow box during tail threading of the wire in the papermaking machine.

21. A method as recited in claim 18 wherein the wire moves in a running direction into the pocket; and wherein (b) is practiced so as to blow air in a direction opposite to the wire running direction to prevent air from being transported into the pocket with the wire.

22. An arrangement for improving the runnability of a web being transported by a transport element on a first face thereof, comprising:

a stationary frame located adjacent a second face of the transport element, opposite the first face, and spaced therefrom a distance D;

a sealing element pivotally connected to the frame for pivotal movement of a free end thereof toward and away from the transport element second face;

an air nozzle connected to said sealing element, which blows air from said sealing element toward the transport element; and a biasing element acting between said frame and said sealing element for biasing said free end of said sealing element toward the transport element so that said free end is spaced a distance d from the transport element, wherein D>d.

23. An arrangement as recited in claim 22 wherein said biasing element comprises a spring.

24. An arrangement as recited in claim 22 wherein said air nozzle is mounted adjacent said sealing element free end for movement therewith.

25. An arrangement as recited in claim 24 wherein said free end of said sealing element has a convex surface, and wherein said air nozzle is formed by an outlet channel in said sealing element positioned with respect to said surface so that air from said air nozzle flows smoothly along said convex surface.

26. A blow box assembly recited in claim 24 wherein sealing element has a free end with a Coanda surface, and wherein said air nozzle is formed by an outlet channel in said sealing element positioned with respect to said surface so that air from said air nozzle flows smoothly along said Coanda surface.

27. An arrangement as recited in claim 22 wherein said air nozzle is stationary so that said sealing element free end may move without moving said air nozzle.

28. An arrangement as recited in claim 22 further comprising an actuator for moving said sealing element against the bias of said bias element so that said free end is spaced a distance d from the transport element, wherein d'>d.

* * * * *